US006880921B2

(12) United States Patent
Aponte et al.

(10) Patent No.: US 6,880,921 B2
(45) Date of Patent: Apr. 19, 2005

(54) INKJET CARTRIDGE WITH TUBULAR ENTRAINED INK CHAMBER

(75) Inventors: Mirayda A. Aponte, Aguidilla, PR (US); Julio A. Rodriguez-Mojica, San Juan, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 101 days.

(21) Appl. No.: 10/243,709

(22) Filed: Sep. 12, 2002

(65) Prior Publication Data

US 2004/0051765 A1 Mar. 18, 2004

(51) Int. Cl.[7] ..... B41J 2/175
(52) U.S. Cl. ..... 347/86; 347/87
(58) Field of Search ..... 347/7, 85, 86, 347/87

(56) References Cited

U.S. PATENT DOCUMENTS

| | | | | |
|---|---|---|---|---|
| 5,216,450 A | * | 6/1993 | Koitabashi et al. | 347/87 |
| 5,509,140 A | | 4/1996 | Koitabashi | |
| 5,801,737 A | * | 9/1998 | Sato et al. | 347/86 |
| 5,980,028 A | * | 11/1999 | Seccombe | 347/85 |
| 5,997,121 A | * | 12/1999 | Altfather et al. | 347/7 |
| 6,431,698 B1 | * | 8/2002 | Mou et al. | 347/86 |

* cited by examiner

*Primary Examiner*—Anh T. N. Vo

(57) ABSTRACT

An inkjet cartridge for use with a thermal inkjet printer includes a free ink chamber with a tube disposed therein, wherein the tube defines therein an entrained ink chamber. The tube can extend from the top of the free ink chamber to the bottom thereof. The tube is preferably laterally enveloped by the free ink chamber. The tube has an interior surface on which a longitudinal channel can be defined, and wherein the channel can be helical.

18 Claims, 2 Drawing Sheets

INKJET CARTRIDGE WITH TUBULAR ENTRAINED INK CHAMBER

FIELD OF THE INVENTION

The invention claimed and disclosed herein pertains to thermal inkjet printers, and more specifically, to ink cartridges employed in conjunction therewith.

BACKGROUND OF THE INVENTION

Imaging apparatus include devices that are configured to selectively produce predefined images on one or more types of imaging media. Examples of images produces by imaging apparatus include letters and other documents, as well as graphical images such as photographs and the like. Among the various types of imaging apparatus that are presently available, the type generally known as the "inkjet printer" is one of the more popular. Although the general operation and function of inkjet printers is well known in the art, a brief overview is provided herein.

The operation of a typical inkjet printer involves advancing, or moving, a sheet of paper (or other imaging media) vertically (typically) relative to a print nozzle from which tiny droplets of ink are precisely and accurately projected, or "fired," onto the paper in order to produce the desired image. The print nozzle is also typically independently movable in transverse relation to the direction of advancement of the imaging media. Thus, the advancement of the paper, along with the transverse movement relative thereto of the print nozzle, effectively provides the print nozzle with a two-dimensional range of movement relative to the sheet of paper upon which the image is to be printed.

Typical inkjet printers include one or more ink cartridges, each having at least one reservoir chamber in which ink is stored for use. The reservoir chamber is generally defined, or enclosed, by a multifaceted, enclosed wall that is usually fabricated from rigid plastic or the like. The print nozzle, or nozzle assembly, which is mentioned above, is also included with each ink cartridge. The nozzle assembly is usually supported on the exterior of the wall which defines the reservoir chamber. Ink from the reservoir chamber is directly supplied to the nozzle assembly through an opening in the wall.

The nozzle assembly generally defines one or more capillary passages into which ink from the chamber is allowed to flow. More specifically, each capillary passage has two opposite termini, wherein one of the termini is fluidly communicable with the reservoir chamber and the other termini is precisely oriented so as to be directed, or aimed, at the imaging media.

In many applications the nozzle assembly generally also includes a selectively controlled heater associated with at least one capillary passage. Each heater is typically in the form of a selectively controlled electrical resistor, or the like, that is capable of providing a nearly instantaneous and substantial increase in temperature, thereby vaporizing a portion of the ink within the associated capillary passage.

The vaporization of the ink within the capillary passage causes the formation of a rapidly expanding "bubble" of ink vapor within the capillary passage which, in turn, causes a droplet of ink to be projected out of the capillary passage and toward the sheet of paper. The vapor "bubble" quickly contracts by cooling, and/or escapes from the capillary passage, whereupon the capillary passage is replenished with liquid ink is drawn into the capillary passage from the reservoir chamber by way of capillary attraction.

A well-known practice within the art is to employ a type of foam material within the reservoir chamber to control the flow of ink out of the chamber and to control the flow of air into the chamber. For example, it is known that such employment of foam material can prevent the unintended leakage, or "drooling," of ink out of the nozzle. A common type of foam material thus employed is that of open cell urethane foam.

The foam functions to control ink flow by way of capillary attraction. That is, the cells and passages within the foam material are generally of a size that will cause ink to be drawn into the foam material by way of capillary attraction. One example of a foam-type ink reservoir system is described in U.S. Pat. No. 5,509,140, which is hereby incorporated herein by reference in its entirety.

Thus, a typical inkjet cartridge contains a given quantity of foam material in which a given volume of ink can be "entrained," or absorbed by way of capillary attraction. Generally, the foam material is located substantially adjacent to the nozzle assembly so that ink is drawn directly to the nozzle assembly from the foam, although in most cases, a small open chamber called a "standpipe area" is employed between the foam and the nozzle assembly. Thus, typically, the ink is drawn into the standpipe area from the foam and then is drawn from the standpipe area in to the nozzle assembly for firing.

One specific type of prior art ink cartridge configuration consists of a single reservoir chamber that is substantially filled with foam in which ink can be entrained. In such a configuration, substantially the entire quantity of ink available for printing is entrained within the foam material. However, another prior art ink cartridge configuration has both a free ink chamber and an entrained ink chamber that are substantially separated from one another by a dividing barrier that is usually incorporated into the wall that is described above.

In such a two-chamber configuration, both the entrained ink chamber and the free ink chamber are generally rectilinear, and the barrier separating them is generally in the form of a substantially flat, rigid panel. A port, or hole, is usually defined near the bottom of the panel, whereby ink can migrate between the free ink chamber and the entrained ink chamber. The entrained ink chamber of such a two-chamber configuration is generally substantially filled with a quantity of foam material, while the free ink portion is generally simply an open chamber in which a quantity of free-flowing ink can be contained.

In either of the prior art inkjet cartridge configurations discussed above, the capillary attraction of the ink into the foam material generally at least partially counteracts the head pressure of the ink with respect to the nozzle assembly. That is, the capillary characteristics of the foam material in addition to the capillary characteristics of the capillary passage of the nozzle assembly generally overcome the head pressure of the ink within the chamber.

This counteractive characteristic provided by the capillary attraction of the foam material is generally referred to as "back pressure" and tends to prevent the ink from leaking or drooling out of the nozzle assembly until the ink is fired by way of the heater as explained above. The capillary characteristics of the foam material provide other benefits in connection with the function of a typical ink cartridge as is explained below.

The typical ink cartridge, whether a one-chamber or a two-chamber configuration, also generally includes a vent system that allows air to enter the ink cartridge to displace ink that is removed from the cartridge because of the printing process. Generally, a typical vent system includes a vent opening that is defined in the cartridge, preferably near the top of the entrained ink chamber, wherein the vent opening is fluidly communicable with the ambient atmosphere.

In the two-chamber type of ink cartridges that consist of both an entrained ink portion and a free ink portion, the foam material is located in the entrained ink chamber between the vent opening and the port which leads to the free ink chamber, so that air entering the cartridge by way of the vent opening must travel past the foam material before entering the free ink portion of the chamber. That is, the ink in the free ink chamber is generally sealed from ambient pressure by way of the foam material and the ink entrained therein. Additionally, the foam is substantially adjacent to the nozzle assembly, or the standpipe area, as explained above.

As the ink is consumed from the ink cartridge as the result of the printing process, the ink is drawn into the nozzle assembly from the foam material as mentioned above. This, in turn, causes free ink to flow from the free ink chamber of the cartridge and into the foam of the entrained ink chamber by way of the port. This flow of free ink into the foam material is aided both by the head pressure of the ink in the free ink chamber and by the capillary attraction of the foam material.

However, as ink is drawn from the free ink chamber, the level of the ink therein falls which results in a decrease in head pressure. Additionally, as the ink level within the free ink chamber falls as it is drawn therefrom, a partial vacuum develops in the free ink chamber above the volume of free ink. This buildup of the partial vacuum in the free ink chamber above the free ink tends to further impede the flow of ink out of the free ink chamber.

Consequently, as the level of free ink falls in the free ink chamber, the level of ink entrained within the foam material in the entrained ink chamber correspondingly falls because the capillary attraction of the foam material is resisted by the vacuum formed in the free ink chamber. As the level of entrained ink continues to fall along with a continued vacuum build up above the free ink, a point is reached at which atmospheric air at ambient pressure overcomes the seal provided by the foam material and the ink entrained therein, whereupon a quantity of atmospheric air forces its way past the foam and entrained ink, thereby entering into the free ink chamber by way of the port.

The entrance of atmospheric air into the free ink chamber in this manner at least partially relieves the vacuum buildup therein and above the free ink, thus increasing the effective head pressure of the free ink with respect to the foam material. As a result of the entrance of the air into the free ink chamber as explained above, ink migrates more freely from free ink chamber and into the entrained ink chamber, causing the level of entrained ink in the entrained ink chamber to rise. The rising level of ink in the entrained ink chamber again creates a seal against atmospheric air which, in turn, allows a partial vacuum to again begin building up in the free ink chamber. This "self-regulating" cycle continues until substantially all of the ink is used up from the cartridge.

As mentioned briefly above, prior art two-chamber ink cartridges generally include an interior dividing barrier in the form of a flat panel wall that separates the entrained ink chamber from the free ink chamber. That is, prior art two-chamber ink cartridges generally include two distinct side-by-side chambers, wherein one chamber is substantially filled with foam material and the other chamber is devoid of foam material.

The port defined in the wall is generally in the form of an orifice or a passage through which ink flows from the open free ink chamber into the foam-filled entrained ink chamber. Likewise, air flows in the opposite direction, from the entrained ink chamber to the free ink chamber, during the self-regulating pressure equalization process which is described above. Additionally, as mentioned above, the vent opening and the nozzle assembly are generally fluidly communicable with the foam-filled entrained ink chamber, while being substantially sealed from the free ink chamber by the foam material.

A feature that is generally common to most, if not all, two-chamber prior art ink cartridges is that the foam-filled entrained ink chamber is substantially dimensionally and volumetrically comparable to the open free ink chamber. In other words, it is not uncommon for a prior art ink cartridge to have a foam-filled entrained ink chamber that is at least fifty percent as large as the open free ink chamber. This aspect of the prior art is generally undesirable in that such relatively large quantities of foam material displace equally large volumes of ink. That is, the foam material of prior art ink cartridges displaces a significant quantity of ink notwithstanding the capability of the foam material to "absorb" a given quantity of ink.

Thus, while prior art ink cartridges are known to function satisfactorily, the volumetric efficiency of the typical prior art ink cartridge is poor. That is, a substantial portion of the ink storage capacity of a typical prior art ink cartridge is devoted to housing a relatively large quantity of foam material that displaces an equal volume of ink which could otherwise be stored in the cartridge. In other words, prior art ink cartridges could typically store a significantly greater volume of ink if not for ink otherwise displaced by the foam material. Therefore, an increase in the volumetric efficiency of prior art ink cartridges is desirable.

What is needed then is an inkjet cartridge that achieves the benefits to be derived from similar prior art devices, but which avoids the shortcomings and detriments individually associated therewith.

SUMMARY OF THE INVENTION

In accordance with one aspect of the present invention, an inkjet cartridge includes a wall that encloses a free ink chamber, and a tube, extending from the interior surface of the wall. The tube defines therein an entrained ink chamber. The entrained ink chamber is fluidly communicable with the free ink chamber by way of an ink port that is defined through the side of the tube. A vent opening and a discharge opening are defined through the wall and the tube is fluidly communicable at respective opposite distal ends thereof with both the vent opening and the discharge opening.

In accordance with another aspect of the present invention, an inkjet cartridge includes a wall that encloses a free ink chamber, wherein a vent opening and a discharge opening are defined through the wall. The inkjet cartridge also includes an elongated tube disposed within the free ink chamber, whereby opposite and distal ends thereof each respectively fluidly communicate with the vent opening and the discharge opening, and whereby the tube is substantially laterally enveloped by the free ink chamber. An ink port can be defined through the tube, thereby facilitating fluid communication between the free ink chamber and the entrained ink chamber. The inkjet cartridge can also include a capillary reticulate material that is disposed within the tube and which substantially fills the tube and covers ink port.

In accordance with yet another embodiment of the present invention, an inkjet cartridge includes a wall that is made up of a top panel, an opposite bottom panel, two opposed side panels, a front panel and an opposed back panel which are connected together to thereby enclose a free ink chamber. A vent opening can be defined through the top panel while a discharge opening is defined through the bottom panel. The inkjet cartridge can also include, disposed within the free ink chamber, a cylindrical tube that is positioned so as to substantially circumscribe, at respective opposite ends thereof, the vent opening and the discharge opening.

These and other aspects and embodiments of the present invention will now be described in detail with reference to the accompanying drawings, wherein:

DETAILED DESCRIPTION OF THE INVENTION

As is described below in conjunction with the accompanying figures, an inkjet cartridge in accordance with any of the various embodiments of the present invention provides a free ink chamber and an entrained ink chamber which can together function in a manner similar to that of known inkjet cartridges. However, in accordance with the present invention, an inkjet cartridge in accordance with any of the various embodiments thereof can provide a significant increase in free ink chamber volume as compared with a prior art inkjet cartridge of similar exterior dimensions, thus providing an inkjet cartridge with greater volumetric efficiency compared with prior art devices.

Figure 1:
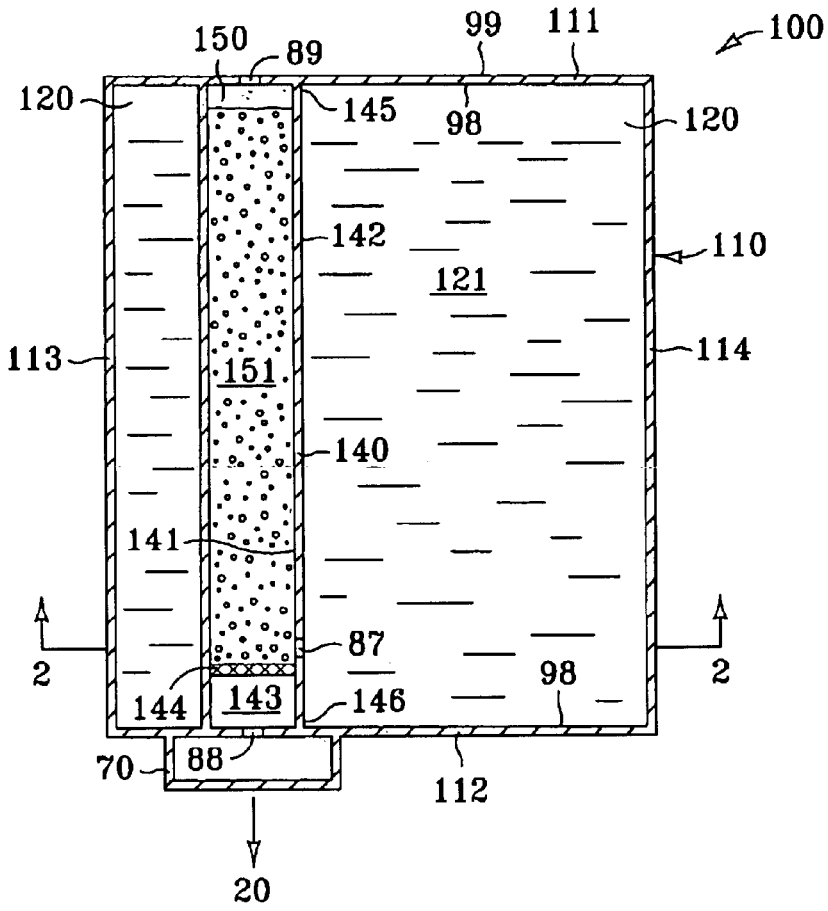
FIG. 1 is a side sectional view of an inkjet cartridge in accordance with one embodiment of the present invention.
Figure 2:
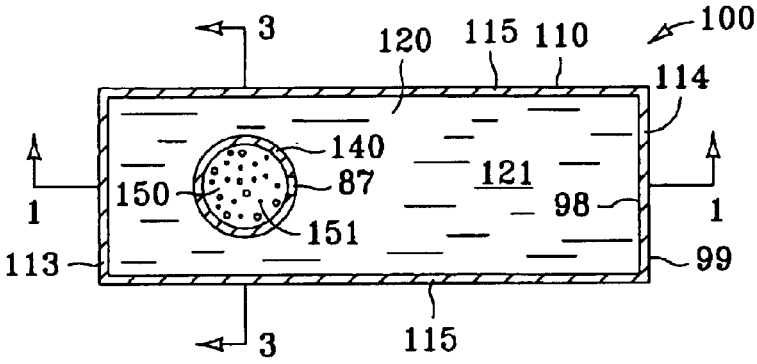
FIG. 2 is a top sectional view of the inkjet cartridge depicted in FIG. 1.

With reference to FIGS. 1 and 2, a side sectional view and a top sectional view are shown, respectively, in which an inkjet cartridge 100 in accordance with one embodiment of the present is depicted. The inkjet cartridge 100 includes a wall 110 that defines, or encloses, a free ink chamber 120. The free ink chamber 120 is configured to contain a volume of liquid 121, wherein the liquid is preferably ink.

The wall 110 has an interior surface 98 and an opposite exterior surface 99. The interior surface 98 is exposed to the free ink chamber 120. The wall 110 is preferably substantially structurally rigid and can include a plurality of substantially flat panels, or facets. For example, the wall 110 can include a substantially flat top panel 111 and substantially flat bottom panel 112 that are preferably oriented in substantially parallel, spaced-apart, juxtaposed relation to one another as is seen.

The wall 110 can also preferably include a substantially flat front panel 113 in substantially normal orientation relative to the top panel 111. The wall 110 can further preferably include a substantially flat back panel 114 in substantially normal orientation relative to the top panel 111. As is also seen, the front panel 113 and the back panel are preferably oriented in substantially parallel, spaced-apart, juxtaposed relation to one another.

Moreover, the wall 110 can include a pair of substantially flat, spaced-apart side panels 115 that are oriented in substantially parallel, juxtaposed relation to one another. The side panels 115, as well as the font panel 113 and back panel 114, preferably extend between the top panel 111 and the bottom panel 112 as shown so as to lend a substantially rectilinear cross sectional shape to the free ink chamber 120 as is seen.

While the ink cartridge 100 of FIG. 2 is depicted as being rectangular, it is understood that the ink cartridge can have any of a number of possible alternative shapes. For example, the inkjet cartridge 100 can, in the alternative, be round, triangular, or elliptical and the like. It will thus be appreciated that the term "wall" does not mean a single, flat panel, but a perimeter enclosure generally defining the main body of an ink jet cartridge.

With further reference to FIGS. 1 and 2, it is seen that a vent opening 89 is preferably defined through the wall 110. The vent opening is preferably located near the top of the wall 110 and is more preferably defined in the top panel 111 as is shown. Similarly, a discharge opening 88 is preferably defined through the wall 110. The discharge opening 88 is preferably located near the bottom of the wall 110 and is more preferably defined through the bottom panel 112 as is depicted.

The inkjet cartridge 100 preferably includes an inkjet nozzle assembly 70. The inkjet nozzle assembly 70 is preferably supported by the wall 110 in operative fluidly communicable relation to the discharge opening 88. That is, the nozzle assembly 70 is preferably situated as shown so as to receive ink by way of the discharge opening 88. The inkjet nozzle assembly 70 is preferably configured to selectively project droplets of ink in the generally direction indicated by the arrow marked 20. The operation of the inkjet nozzle assembly is explained above with respect to the prior art.

With continued reference to FIGS. 1 and 2, it is seen that the inkjet cartridge 100 includes an elongated tube 140 disposed within the free ink chamber 120. The tube 140 defines therein an entrained ink chamber 150. A first end 145 and an opposite and distal second end 146 are defined on the tube 140 as depicted, wherein the entrained ink chamber 150 is defined within the tube and between the first end 145 and second end 146 thereof. An ink port 87, or opening, is preferably defined through the tube 140 proximate the second end 146 thereof.

The tube 140 extends into the free ink chamber 120 from the interior surface 98 of the wall 110, and preferably extends from the bottom panel 112 proximate the discharge opening 88, as is depicted. Also, both the first end 145 and the second end 146 of the tube 140 are preferably connected with the interior surface 98 of the wall 110, whereby the tube substantially fluidly connects the vent opening 89 with the discharge opening 88.

More preferably, the first end 145 of the tube 140 is connected with the top panel 111 of the wall 110, while the second end 146 of the tube is connected with the bottom panel 112 of the wall. Also, the tube 140 is preferably substantially normally oriented relative to both the top panel 111 and the bottom panel 112 as shown.

The entrained ink chamber 150 is most preferably fluidly communicable both with the vent opening 89 proximate the first end 145 of the tube 140, and with the discharge opening 88 proximate the second end 146 of the tube. Also, the entrained ink chamber 150 is preferably substantially sealed from the free ink chamber 120 except by way of the ink port 87.

The inkjet cartridge 100 preferably includes a capillary reticulate material 151 that is operatively disposed within the entrained ink chamber 150 between the first end 145 and the second end 146 of the tube 140. The term "capillary reticulate material" as used herein refers to a material that is capable of absorbing a quantity of ink by way of capillary attraction so as to function in the manner discussed herein with respect to the capillary reticulate material 151.

That is, the general function of the capillary reticulate material 151 is substantially similar to that of the foam material of the prior art which is described above. While the capillary reticulate material 151 is preferably a cured open cell foam material such as urethane foam, it is understood that the capillary reticulate material is in no way intended to be limited to foam, and it is further understood that the capillary reticulate material can be any type of material, including fibers, granules, and the like, which functions in the manner of the capillary reticulate material as is described herein.

Regardless of the specific type of material employed, the capillary reticulate material 151 preferably substantially fills the entrained ink chamber 150 between the vent opening 89 and the discharge opening 88. The capillary reticulate material 151 is further preferably configured to be compressed within entrained ink chamber 150 to a degree that will provide desired characteristics as is known in the art.

Additionally, the capillary reticulate material 151 preferably substantially covers the ink port 87 as depicted in FIG. 1. As is also depicted in FIG. 1, a stand pipe area 143 can be defined within the tube 140. The standpipe area 143 is preferably adjacent to the discharge opening 88 and below the ink port 87. A filter 144 can also be included in the inkjet cartridge 100, wherein the filter is located substantially between the capillary reticulate material 151 and the standpipe area 143.

As is further seen from an examination of FIG. 1, the tube 140 is preferably substantially straight and preferably has a substantially constant cross-sectional dimension and shape. The cross-sectional shape of the tube 140 is preferably circular. Also, preferably, the tube 140 is substantially cylindrical. However, other alternative cross-sectional shapes are possible, which include those of ovate, elliptical, triangular, rectilinear, and the like. Additionally, the tube 140 is preferably substantially structurally rigid.

It is understood that the tube 140 and the wall 110 can alternatively be fabricated either separately, or integrally relative to one another in accordance with any of a number of known fabrication processes. That is, for example, the tube 140, the bottom panel 112, the side panels 115, the front panel 113, and the back panel 114, can be integrally fabricated in the form of a unitary injection-molded plastic piece.

In that case, the top panel 111 can be a separate injection-molded piece that is subsequently bonded to the tube and to the remainder of the panels to form the completed free ink chamber 120 and entrained ink chamber 140 as depicted in the accompanying figures. Alternatively, several of the aforementioned components can be separately fabricated and subsequently bonded together to generally result in the configuration depicted.

With reference now to both FIGS. 1 and 2, it is seen that the tube 140 is preferably substantially laterally enveloped by the free ink chamber 120. That is, the tube 140 is preferably located within the free ink chamber 120 in a manner such that the free ink chamber completely surrounds the tube on its sides. Stated yet another way, the exterior surface 142 of the tube 140 is preferably continuously exposed to the free ink chamber 120, whereby the exterior surface of the tube does not contact the wall 110. In other words, the wall 110 contacts the tube 120 preferably only at the first end 145 and/or the second end 146 thereof. Additionally, the first end 145 of the tube 140 preferably circumscribes the vent opening 89, while the second end 146 of the tube preferably circumscribes the discharge opening 88.

Figure 3A:
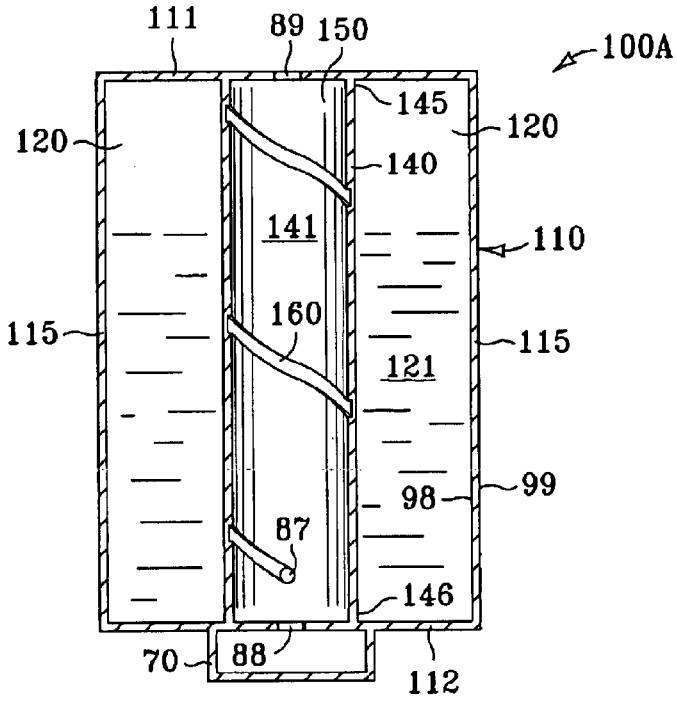
FIG. 3A is an end sectional view of the inkjet cartridge depicted in FIGS. 1 and 2, showing one alternative configuration of the channel within the entrained ink chamber.
Figure 3B:
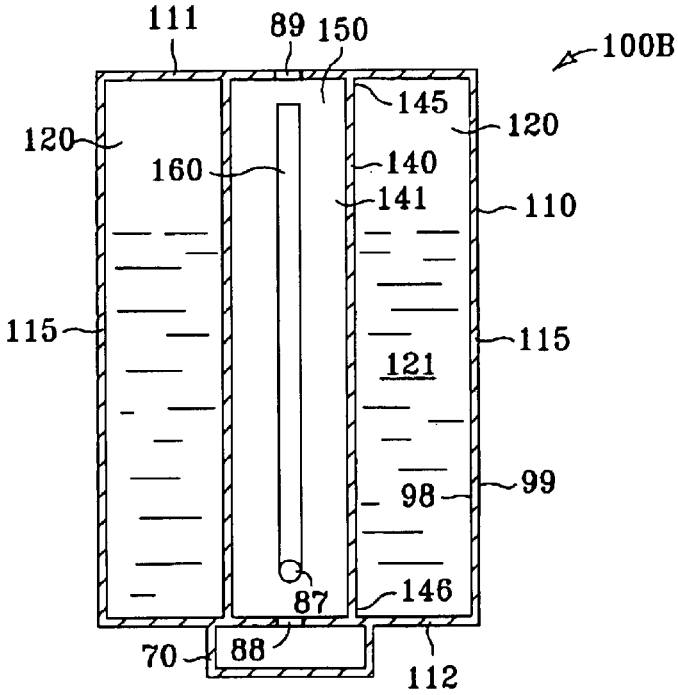
FIG. 3B is another end sectional view of the inkjet cartridge depicted in FIGS. 1 and 2, showing another alternative configuration of the channel within the entrained ink chamber.

Moving now to FIGS. 3A and 3B, two front sectional views are shown in which the inkjet cartridges 100A and 100B are depicted, respectively, in accordance with either of two possible alternative configurations as is explained below. That is, the inkjet cartridge 100A that is shown in FIG. 3A can be identical to the inkjet cartridge 100 that is discussed above with respect to FIGS. 1 and 2, except for the channel 160 as discussed below. Similarly, the inkjet cartridge 100B that is shown in FIG. 3B can be identical to the inkjet cartridge 100 with the exception of the channel 160 as described below. It is further noted that the capillary reticulate material 151, as well as the filter 144, that are shown in FIGS. 1 and 2 have been omitted from FIGS. 3A and 3B for clarity.

An examination of FIGS. 3A and 3B reveals that the interior surface 141 of the tube 140 can define thereon an open channel 160. The channel 160 is preferably substantially longitudinally oriented relative to the tube 140. That is, the channel 160 is preferably oriented so that it leads substantially between the first end 145 and the second end 146 of the tube 140. Also, the channel 160 preferably leads, or extends, upward from the ink port 87. In other words, the channel 160 preferably leads from the ink port 87 and toward the first end 145 of the tube 140.

The channel 160 can have any of a number of possible specific orientations relative to the tube 140. For example, as illustrated in FIG. 3A, the channel 160 can have a substantially helical, or spiral, configuration. Such a helical configuration of the channel 160 is particularly applicable in configurations in which the interior surface 141 of the tube 140 is continuous, and most particularly wherein the tube is a circular cylinder. Moreover, the channel 160 can have any of a number of possible alternative cross-sectional shapes.

As illustrated in FIG. 3B, the channel 160 can alternatively be substantially straight and substantially parallel with the tube 140. Such a straight configuration of the channel 160 can be particularly well suited in applications wherein the interior surface 141 of the tube 140 is discontinuous as in the case wherein the cross-sectional shape of the tube is rectilinear or the like.

In any case, the channel 160 most preferably intersects, or runs into, the ink port 87 as is depicted in both FIGS. 3A and 3B. The channel 160 functions to assist in regulating the internal pressure of the free ink chamber 120 in a manner similar to that described above with respect to the prior art. Accordingly, the channel 160 can be any length as is required for the particular application in conjunction with which it is employed.

Now referring to FIGS. 1 and 2, in preparation for use of the inkjet cartridge 100 in a conventional inkjet printer (not shown), the free ink chamber 120 as well as the entrained ink chamber 140 are preferably initially filled with fluid 121 that is most preferably ink. That is, before initial use of the inkjet cartridge 100, the free ink chamber 120 is preferably substantially filled ink and the capillary reticulate material 151 also preferably has a volume of ink entrained therein.

The inkjet cartridge 100 can then be employed in conjunction with a conventional inkjet printer apparatus (not shown), wherein ink is selectively projected from the inkjet nozzle assembly 70. As the ink is projected from the nozzle assembly in this manner, ink is drawn from the entrained ink chamber 150 to replenish the ink projected from the nozzle assembly 70. As ink is drawn from the entrained ink chamber 150, ink from the free ink chamber 120 flows into the capillary reticulate material 151 by way of the ink port 87.

As the level of ink in the free ink chamber 120 drops in this manner, a partial vacuum can develop above the ink and within the free ink chamber. This buildup of a partial vacuum within the free ink chamber 120 impedes the flow of ink from the free ink chamber to the entrained ink chamber. This, in turn, results in a drop in the level of ink entrained within the capillary reticulate material 151. A continued drop in the level of ink entrained within the capillary reticulate material enables ambient air to enter through the vent opening 89 and to travel past the capillary reticulate material and into the free ink chamber 120 by way of the ink port.

This entrance of air into the free ink chamber 120 at least partially relieves the vacuum condition therein which allows an increase in the flow of ink out of the free ink chamber and into the entrained ink chamber 150. This increase in flow of ink into the entrained ink chamber 150 causes the level of entrained ink to increase, thus blocking the flow of air through the ink port 87. Upon such a blocking of air flow through the ink port 87, the above cycle repeats indefinitely until substantially all of the ink is depleted from the inkjet cartridge 100.

With reference now to FIGS. 3A and 3B, the channel 160 that can be defined in the interior surface 141 of the tube 140 as discussed above can serve to facilitate the entrance of air into the free ink chamber 120 by way of the ink port 87. That is, the length of the channel 160 can affect the frequency at which the above-described self-regulating cycle is repeated.

As can be appreciated from the forgoing discussion in conjunction with the accompanying figures, the inkjet cartridge 100 of the present invention provides a free ink chamber 120 and an entrained ink chamber 150 that can function in a manner similar to that of known inkjet cartridges as explained above. However, the inkjet cartridge 100 in accordance with the present invention can provide a significant increase in free ink chamber volume as compared with a prior art inkjet cartridge of similar exterior dimensions, thus providing an inkjet cartridge with greater volumetric efficiency compared with prior art devices.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An inkjet cartridge, comprising:

a wall that encloses a free ink chamber, wherein the wall has an exterior surface and an opposite interior surface, and wherein the wall defines therethrough a discharge opening and a vent opening; and, an elongated tube extending from the interior surface of the wall and into the free ink chamber, wherein the tube has a first end and a distal second end, and wherein:

an entrained ink chamber is defined within the tube between the first end and the second end thereof;

the entrained ink chamber is fluidly communicable with the vent opening proximate the first end, and is fluidly communicable with the discharge opening proximate the second end; and, the tube defines an ink port therethrough, whereby the entrained ink chamber is substantially sealed from the free ink chamber except by way of the ink port.

2. The inkjet cartridge of claim 1, and wherein the wall comprises:

a substantially flat top panel; and, a substantially flat bottom panel, wherein the top panel and the bottom panel are oriented in substantially parallel, spaced-apart, juxtaposed relation to one another, and wherein the vent opening is defined through the top panel and the discharge opening is defined through the bottom panel.

3. The inkjet cartridge of claim 2, and wherein:

the tube is substantially straight;

the tube extends between the top panel and the bottom panel; and, the tube is in substantially normal orientation relative to the top panel and to the bottom panel.

4. The inkjet cartridge of claim 1, and wherein the tube has a substantially circular cross-section.

5. The inkjet cartridge of claim 1, and further comprising an inkjet nozzle assembly operatively supported on the wall fluid-communicable relation to the discharge opening.

6. The inkjet cartridge of claim 1, and further comprising a capillary reticulate material operatively disposed within the tube, wherein the capillary reticulate material is located substantially between the vent opening and the discharge opening, and wherein the capillary reticulate material substantially covers the ink port.

7. The inkjet cartridge of claim 1, and wherein the tube has an interior surface on which is defined a substantially longitudinally oriented open channel.

8. The inkjet cartridge of claim 7, and wherein the channel is substantially straight and substantially parallel with the tube.

9. The inkjet cartridge of claim 7, and wherein the channel is substantially helical.

10. The inkjet cartridge of claim 1, and wherein the tube is substantially laterally enveloped by the free ink chamber.

11. An inkjet cartridge, comprising:

a wall that defines a free ink chamber, wherein the wall further defines a vent opening therethrough and a discharge opening therethrough; and, an elongated tube disposed within the free ink chamber, wherein:

the tube defines therein an entrained ink chamber;

the tube has a first end and a distal second end;

the tube defines an ink port therethrough intermediate the first end and the second end;

the first end is fluidly communicable with the vent opening and the second end is fluidly communicable with the discharge opening;

the free ink chamber substantially laterally envelopes the tube; and, the tube has an interior surface on which is defined a substantially longitudinal channel.

12. The inkjet cartridge of claim 11, and wherein the tube is substantially cylindrical.

13. The inkjet cartridge of claim 12, and wherein the channel is substantially helical.

14. An inkjet cartridge, comprising:

a wall that defines a substantially enclosed free ink chamber, the wall comprising:

a substantially flat bottom panel through which is defined a discharge opening;

a substantially flat top panel through which is defined a vent opening and which is spaced apart from, and oriented in substantially parallel juxtaposed relation to, the bottom panel;

a pair of substantially flat spaced-apart side panels oriented in substantially parallel juxtaposed relation to one another and extending between, and in substantially normal relation to, the top panel and the bottom panel;

a substantially flat front panel extending between, and oriented substantially normally to, the top panel, the bottom panel, and each of the side panels; and, a substantially flat back panel spaced apart from, and oriented in substantially parallel juxtaposed relation to the front panel, and extending between, and oriented substantially normally to, the top panel, the bottom panel, and each of the side panels to thereby enclose and define the free ink chamber; and, a substantially cylindrical tube extending between, and substantially normally relative to, the bottom panel and the top panel, wherein the tube substantially seals the vent opening and the discharge opening from the free ink chamber except by way of an ink port defined through the tube.

15. The inkjet cartridge of claim 14, and wherein the tube is substantially laterally enveloped by the free ink chamber.

16. The inkjet cartridge of claim 15, and further comprising a capillary reticulate material disposed within the tube between the first end and the second end thereof, thereby substantially filling the entrained ink chamber and substantially covering the ink port.

17. The inkjet cartridge of claim 16, and wherein the tube has an interior surface on which is defined an open channel that intersects the ink port.

18. The inkjet cartridge of claim 17 and wherein the channel is substantially helical.

* * * * *